US009084470B1

(12) United States Patent
Huck

(10) Patent No.: US 9,084,470 B1
(45) Date of Patent: Jul. 21, 2015

(54) UTILITY HARNESS

(76) Inventor: Joel C. Huck, Houston, TX (US)

( * ) Notice: Subject to any disclaimer, the term of this patent is extended or adjusted under 35 U.S.C. 154(b) by 48 days.

(21) Appl. No.: 13/540,192

(22) Filed: Jul. 2, 2012

(51) Int. Cl.
*A45F 3/14* (2006.01)
*A45F 3/02* (2006.01)
*A45F 3/04* (2006.01)

(52) U.S. Cl.
CPC ..... *A45F 3/14* (2013.01); *A45F 2003/045* (2013.01); *A45F 2003/148* (2013.01)

(58) Field of Classification Search
USPC ..... 224/259, 262, 264, 600, 602, 603, 606, 224/607, 623, 637–639; 2/340, 310
See application file for complete search history.

(56) References Cited

U.S. PATENT DOCUMENTS 1,398,962 A * 12/1921 Graves ..... 2/331
1,816,262 A * 7/1931 Ritter ..... 297/484
1,871,223 A * 8/1932 Reese ..... 224/648
2,437,714 A * 3/1948 Thomason, Jr. ..... 2/310
3,089,143 A * 5/1963 Jacobson ..... 2/1
3,142,844 A * 8/1964 Murray ..... 2/326
D394,338 S * 5/1998 Lacey ..... D2/841
6,125,475 A * 10/2000 Taylor ..... 2/333
6,431,424 B1 * 8/2002 Smith ..... 224/583
6,712,251 B2 * 3/2004 Godshaw et al. ..... 224/675
7,210,605 B2 * 5/2007 Willows et al. ..... 224/637
7,318,542 B2 * 1/2008 Godshaw et al. ..... 224/674
7,845,024 B2 * 12/2010 Hill ..... 2/310
7,891,023 B1 * 2/2011 Hill ..... 2/310
2006/0102423 A1 * 5/2006 Lang et al. ..... 182/36
2010/0072241 A1 * 3/2010 Brown et al. ..... 224/645
2011/0036877 A1 * 2/2011 Boino et al. ..... 224/262
2011/0197335 A1 * 8/2011 Handy ..... 2/117
2014/0033398 A1 * 2/2014 Spina, Sr. ..... 2/327

* cited by examiner

*Primary Examiner* — J. Gregory Pickett
*Assistant Examiner* — Todd Anderson
(74) *Attorney, Agent, or Firm* — Richard L. Moseley

(57) ABSTRACT

A utility harness is disclosed which is worn by a user to carry various recreational and utility equipment. The shoulder harness comprises two belts that cross in the front and rear with the ends at either side being secured together and to the users belt. The ends on either side are secured about a side belt loop on the users trousers to prevent movement of the belts. Attachment devices are secured along the length of the belts and elsewhere upon the harness as needed.

3 Claims, 3 Drawing Sheets

UTILITY HARNESS

BACKGROUND OF THE INVENTION

1. Field of the Invention

The present invention relates to a utility harness to be worn by a user to carry various recreational and utility equipment. More particularly the invention relates to an over the shoulder harness comprising two belts that cross in the front and rear with the ends at either side secured together and to the users belt. More particularly the ends on either side are secured about a side belt loop on the users trousers to prevent movement of the belts. Attachment devices are secured along the length of the belts and elsewhere upon the harness as needed.

2. Related Information

Typical back packs have two straps or belts that are passed over the users shoulders with each strap being secured separately to the pack, its frame or sometimes to the users belt. A most common type of harness is the arrangement used by the military for many years which consists of suspenders which attach to the users pistol belt on the front and rear. The suspenders are connected by a collar near the top rear with the straps extending therefrom. If desired a knapsack could be connected to the pistol belt in the rear and the suspenders shortened to extend from the top of the knapsack over the shoulders to the front of the pistol belt. The suspenders or straps are always extended in parallel fashion down the front of the chest to the connecting point. While relatively secure the parallel type connection allows for sidewise slippage on the shoulders and perhaps off the shoulders, which requires constant monitoring and adjusting of the suspenders or straps. In addition while some utility devices may be secured to the front of the straps, the angle may not be optimal for reaching and grasping the devices.

SUMMARY OF THE INVENTION

Briefly the present invention comprises an improved arrangement of the straps wherein there are two straps or belts which are arranged to cross in the front and back. The crossing arrangement pulls the belts at the shoulder towards the center avoiding the sidewise slippage there. The belts are secured together by collars at the front and rear crossing points such the belts are slidably secured within the collars to allow the belts to move in relation to each other and the collars. The crossing is completed and the ends of the belts are secured together at either side and thence to the users belt. The crossing pattern, especially on the front, provides for a convenient angle to retrieve any devices attached there.

The completed harness comprises:

(a) first and second belts configured such that one of each belt will cross one shoulder of the wearer and cross the other belt in both the front and back of the wearer producing a front crossing point and a rear crossing point, and such that two ends of said belts are adjacent each other on either side of the wearer;

(b) a pair of connectors, one each of said connectors releasably connecting the two adjacent ends of said belts on either side of the wearer;

(c) each of said connectors having a pair of loops for releasably connecting said connectors to the trouser belt, one each of said loops disposed on either side of one of the belt loops;

(d) a rear collar connecting said belts at the rear crossing point such that the belts are slidably secured within said rear collar but may move in relation to said collar and each other;

(e) a front collar connecting said belts at the front crossing point such that the belts are slidably secured within said front collar but may move in relation to said collar and each other; and (f) attachment devices such as snaps or VELVRO® secured along the length of said belts and on said collars for releasably attaching various recreational and utility items thereto.

DESCRIPTION OF THE PREFERRED EMBODIMENT

For a detailed description of the preferred embodiment the reader is directed to the accompanying figures in which like components are given like numerals for ease of reference.

Figures 1, 1A:
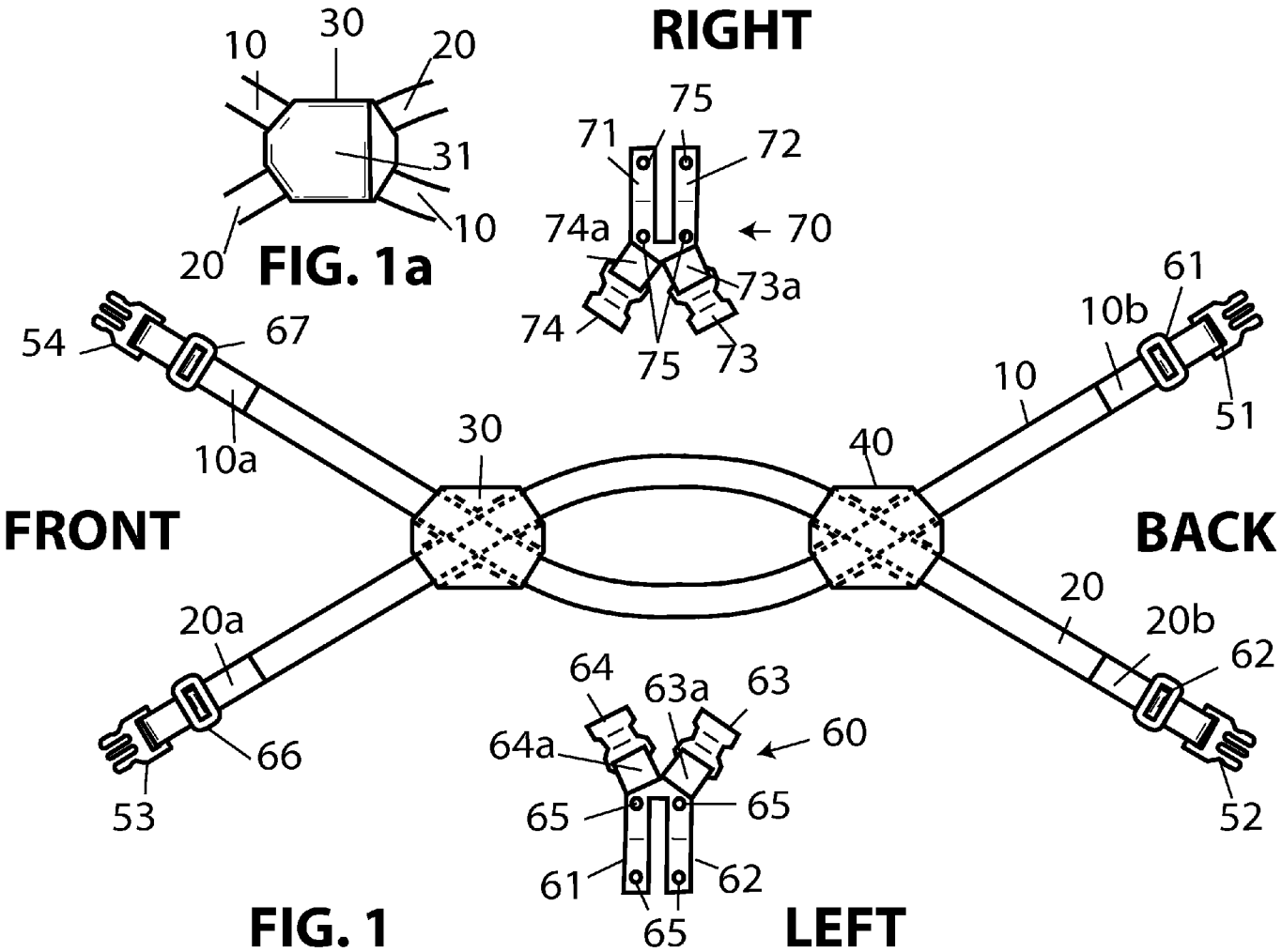
FIG. 1 is top view of one embodiment of the harness of the present invention.
FIG. 1*a* is a top view of one embodiment of the front collar as used in the invention.

Referring first to FIG. 1 an overall top view of the harness is shown as laid out flat. The harness is seen to comprise two belts 10 and 20 arranged such that they cross in two places where they are slidably secured together by two collars, a front collar 30 and a rear collar 40. At either end of the belt 10 various connectors such as three prong type connectors 51 and 54 are secured by being the belt passed through slots (not shown) on the connectors and then extensions 10*a* and 10*b* being passed through adjusting loops 61 and 67 to adjust the length of the belt 10. The Belt 20 has the same arrangement with the belt being passed through slots (not shown) on three prong connectors 52 and 53 and extensions being passed through adjusting loops 62 and 66. Connectors 60 and 70 are provided to connect the ends of the belts together and secure them to the belt of the user. Each connector 60 and 70 has two three prong receptacles 63, 64, 73, 74 respectively to receive the prong connectors 52, 53, 52 and 54 respectively. The three prong receptacles 63, 64, 73, 74 are secured to the respective connector 60, 70 by straps 63*a*, 64*a*, 73*a*, and 74*a*. Each connector 60 and 70 has a pair of loops 61, 62 and 71, 72 with matching snaps 65 or 75 with which to secure the ends together around a users belt as shown below.

Figure 2:
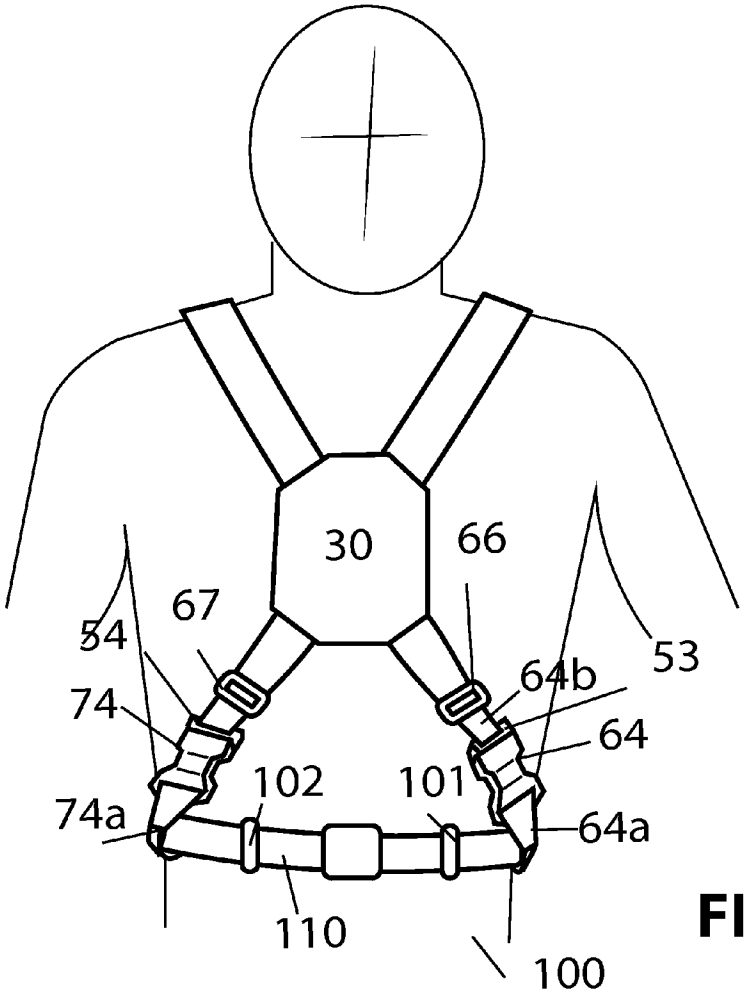
FIG. 2 is a front view of the harness as worn by a user.

Referring now to FIG. 2 the harness is shown from the front as worn by a user. The front collar 30 is situated comfortably near the middle of the users chest with the belts 10 and 20 crossing while being passed through the collar 30. The user is shown to be wearing shorts or trousers 100 having belt loops 101 and 102 through which a belt 110 has been passed. The crossing of the belts 10 and 20 applies a force inward preventing the belts from slipping sidewise off the shoulders. As shown in FIG. 1*a* the collar 30 may have a pocket 31 into which a stiffening plate may be inserted to prevent wrinkling, especially if a heavy item is attached.

Figure 3:
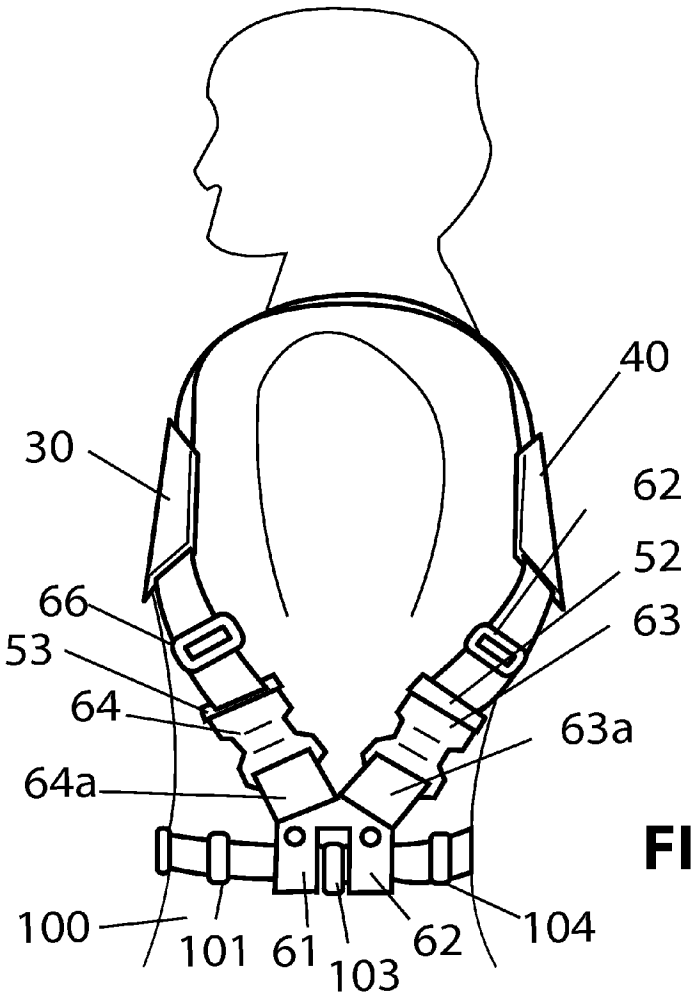
FIG. 3 is a side view of the harness as worn by a user.

Referring now to FIG. 3 a left side view of a user wearing the harness is shown. The connector 60 is secured to the users belt 110 by loops 61 and 62 which are wrapped around the belt and secured to themselves via snaps 65. The loops 61 and 62 are secured on either side of a belt loop 103 to prevent lateral movement of the harness. The belt 20 may be adjusted for fit or comfort by movement of the extensions in adjustment loops 63 and 64. The right side which is not shown is arranged in the same manner.

It should be noted that standard hook and loop tape (VELCRO®) can be substituted for the snaps 65. Also the bayonet connectors may be replaced with standard buckles.

In use, attachment devices in the form of snaps or hook and loop tape or combinations thereof are provided on the belts 10 and 20. In addition the attachment devices may also be provided on the collars. The types of attachment devices may be selected for the weight of the devices attached with the heavier items being secured by snaps and lighter devices by hook and loop tape.

The invention claimed is:

1. A harness for carry carrying various recreational and utility equipment and worn by a wearer, said wearer wearing a trouser belt and a pair of trousers, said trousers having belt loops disposed other either side of said trousers, said harness comprising:

(a) first and second belts configured such that one of each belt will cross one shoulder of the wearer and cross the other belt in both the front and back of the wearer producing a front crossing point and a rear crossing point, and such that two ends of said belts are adjacent each other on either side of the wearer, each of said belts having a three prong connector on each end;

(b) a pair of connectors, one each of said connectors releasably connecting the two adjacent ends of said belts on either side of the wearer;

(c) each of said connectors comprising (1) a connector body having a pair of loops for releasably connecting said connectors to said trouser belt, one each of said loops disposed on either side of one of said belt loops to prevent lateral movement of the harness along the trouser belt, and (2) two three prong connector receptacles secured to each of said connectors by straps, each of said straps extending at an angle of about 45 degrees from the body;

(d) a rear collar connecting said belts at the rear crossing point such that the belts are slidably secured within said rear collar but may move in relation to said collar and each other; and (e) a front collar connecting said belts at the front crossing point such that the belts are slidably secured within said front collar but may move in relation to said collar and each other.

2. A harness for carry carrying various recreational and utility equipment in combination with a trouser belt and a pair of trousers, said trousers having belt loops disposed other either side of said trousers, said harness comprising:

(a) first and second belts configured such that one of each belt will cross one shoulder of the wearer and cross the other belt in both the front and back of the wearer producing a front crossing point and a rear crossing point, and such that two ends of said belts are adjacent each other on either side of the wearer, each of said belts having a three connector prong on each end;

(b) a pair of connectors, one each of said connectors releasably connecting the two adjacent ends of said belts on either side of the wearer;

(c) each of said connectors comprising (1) a connector body having a pair of loops releasably connecting said connectors to said trouser belt, one each of said loops disposed on either side of one of said belt loops to prevent lateral movement of the harness along the trouser belt, and (2) two three prong connector receptacles secured to each of said connectors by straps, each of said straps extending at an angle of about 45 degrees from the body;

(d) a rear collar connecting said belts at the rear crossing point such that the belts are slidably secured within said rear collar but may move in relation to said collar and each other; and (e) a front collar connecting said belts at the front crossing point such that the belts are slidably secured within said front collar but may move in relation to said collar and each other.

3. The harness of claim 2 further comprising a stiffening plate secured within said front collar.

* * * * *